US005613438A

United States Patent [19]

Rehberg

[11] Patent Number: 5,613,438

[45] Date of Patent: Mar. 25, 1997

[54] PRINTING PRESS HAVING AT LEAST ONE PROTECTIVE DEVICE, A PROTECTIVE DEVICE FOR A PRINTING PRESS, AND A METHOD OF OPERATING A PRINTING PRESS

[75] Inventor: Michael Rehberg, Heidelberg, Germany

[73] Assignee: Heidelberger Druckmaschinen Aktiengesellschaft, Heidelberg, Germany

[21] Appl. No.: 377,474

[22] Filed: Jan. 24, 1995

[30] Foreign Application Priority Data

Jan. 26, 1994 [DE] Germany ..... 44 02 158.5

[51] Int. Cl.[6] ..... B41J 5/00

[52] U.S. Cl. ..... 101/216; 101/415.1; 101/477

[58] Field of Search ..... 101/212, 216, 101/415.1, 477; 400/690–690.4, 692, 693

[56] References Cited

U.S. PATENT DOCUMENTS

| | | | |
|---|---|---|---|
| 5,361,699 | 11/1994 | Compera | 101/477 |
| 5,373,787 | 12/1994 | Junghans et al. | 101/212 |
| 5,440,988 | 8/1995 | Ito | 101/477 |
| 5,460,092 | 10/1995 | Beisel et al. | 101/477 |
| 5,487,336 | 1/1996 | Simeth | 101/216 |

FOREIGN PATENT DOCUMENTS 4214049 11/1993 Germany .

*Primary Examiner*—Christopher A. Bennett
*Attorney, Agent, or Firm*—Nils H. Ljungman and Associates

[57] ABSTRACT

A printing press having at least one protective device and a protective device for a printing press, as well as a protective device or protection device on printing presses or printing machines. The protective device is mounted on both sides with swivel arms on shaft journals and can be raised from a closed position into an open position, whereby the pivoting is assisted by a spring element, and whereby the operator can easily pivot the protection device into three positions.

19 Claims, 8 Drawing Sheets

PRINTING PRESS HAVING AT LEAST ONE PROTECTIVE DEVICE, A PROTECTIVE DEVICE FOR A PRINTING PRESS, AND A METHOD OF OPERATING A PRINTING PRESS

BACKGROUND OF THE INVENTION

1. Field of the Invention

The present invention generally relates to a printing press having at least one protective device, wherein such a protective device is mounted on both sides with swivel arms on shaft journals, and can be raised from a closed position into an open position, whereby the pivoting is assisted by a spring element.

The present invention also relates to a protective device, or protection device, on printing presses or printing machines, which protection device is mounted on both sides with swivel arms on shaft Journals, and can be raised from a closed position into an open position, whereby the pivoting is assisted by a spring element.

2. Background Information

Such protection devices are used on printing machines, for example, to prevent, during operation of the printing machine, injuries to the operator by printing mechanisms. Such a protection device can be provided, for example, in the vicinity of the plate cylinder end the blanket cylinder. Such protection devices are usually opened and closed manually, whereby a safety switch can prevent the machine from operating when the protection device is in the open position.

It has been determined that in actual practice, and on large printing machines in particular, the operator has to generally climb up on a footboard or footstep of the machine in order to open the protection device all the way. On the other hand, the operator also has to climb up on this footboard to close the protection devise, which means that unnecessary effort is required, for example, to wash the blanket or the printing plate by hand, because such operations could normally otherwise require the protection device to be lifted only part way, which could normally be possible without climbing up on the footboard. It has been found that, usually, a protective device essentially only needs to be opened all the way if the operator or printer is also working on the inking rollers and the wetting or damping rollers.

OBJECTS OF THE INVENTION

Given the situation discussed hereinabove, an object of the present invention is to make it easier for the operator to actuate a protection device such as that described initially.

SUMMARY OF THE INVENTION

The invention teaches that the above object can be accomplished if the protection device can be lifted into a half-open intermediate position in which the printing device is set on a lever which is supported by a spring element, by means of a stop on the shaft Journals of the protective device. In this half-open position, the operator or printer can change the blanket, for example, without having to climb up on the machine and move the protection device into a stable open position. This makes the operator's work easier, and he or she can reach, essentially from ground level, everything he or she needs to reach. By using a spring element, the operator can return the protection device to the closed position when his or her work is done.

One advantageous embodiment of the invention is characterized by the fact that a shaft journal, which is permanently connected to a pivot arm, preferably supports a disc which has stops on its end surfaces; that a lever is mounted so that it can preferably pivot on the shaft Journals; that the spring element is preferably supported on the outer end of the lever by means of a pin, stud or Journal; that, when the protection device is in the closed position, the spring element and the lever are preferably in a top-dead-center position and are preferably in contact with a stop; that, when the protection device is pivoted from the closed position, the disc, by means of a first stop, preferably pivots the lever with the spring element out of the top-dead-center position into a position in which the spring element is stretched, and that in this position of the spring element, the protective device, in an intermediate position, is preferably placed in contact with the lever by means of a second stop on the disc.

The invention also teaches that it is possible to raise the protection device from the intermediate position into the open position, and in this open position it is placed in contact against a stop which is integral with the free. In one advantageous configuration of the invention, the distance between the two stops on the disc is preferably smaller by several angular degrees than the pivoting range of the lever, so that when the protection device is pivoted into the intermediate position, the lever with the spring element is preferably moved out of the top-dead-center position. In one advantageous embodiment of the invention, the spring element can preferably be a gas compression spring, or pneumatic spring.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

In summary, one aspect of the invention resides broadly in a printing press comprising a frame; a plate cylinder being rot drably mounted on the frame; an inking unit for supplying ink to the plate cylinder; the inking unit comprising an ink fountain for containing ink; a plurality of inking rollers; means for transferring ink between the ink fountain and the plurality of inking rollers; a plurality of ink applicator rollers for transferring ink between the plurality of inking rollers and the plate cylinder; a damping unit for supplying damping medium to the plate cylinder; the printing press having an interior defined within the frame; cover means for selectively permitting access to the interior of the printing press from outside of the printing press; means for mounting the cover means on the printing press frame and for rendering the cover means displaceable with respect to the printing press frame; the cover means being positionable between a first position, a second position and third position, wherein: in the first position, the cover means is substantially fully closed and substantially impedes access to the interior of the printing press; in the second position, the cover means is substantially fully open and permits access to the interior of the printing press; and in the third position, the cover means is positioned intermediately between the first position and the second position and permits access to the interior of the printing press.

Another aspect of the invention resides broadly in a method of operating a printing press, such a printing press comprising: a frame; a plate cylinder being rotatably mounted on the frame; an inking unit for supplying ink to the plate cylinder; the inking unit comprising: an ink fountain for containing ink, a plurality of inking rollers, means for transferring ink between the ink fountain and the plurality of inking rollers, and a plurality of ink applicator rollers for transferring ink between the plurality of inking rollers and the plate cylinder; a damping unit for supplying damping medium to the plate cylinder; the damping unit comprising: a damping medium reservoir for containing damping medium, a form roller being disposed adjacent the plate cylinder, the form roller for transferring damping medium to the plate cylinder, means for transferring damping medium from the damping medium reservoir to the form roller; the printing press having en interior defined within the frame; cover means for selectively permitting access to the interior of the printing press from outside of the printing press; means for mounting the cover means on the printing press frame and for rendering the cover means displaceable with respect to the printing press frame; the cover means being positionable between a first position, a second position and third position, wherein: in the first position, the cover means is substantially fully closed and substantially impedes access to the interior of the printing press; in the second position, the cover means is substantially fully open and permits access to the interior of the printing press; and in the third position, the cover means is positioned intermediately between the first position end the second position and permits access to the interior of the printing press; the method comprising the steps oft providing a frame; providing a plate cylinder and rotatably mounting the plate cylinder on the frame; providing an inking unit for supplying ink to the plate cylinder; configuring the inking unit to comprise: an ink fountain for containing ink; a plurality of inking rollers; means for transferring ink Between the ink fountain and the plurality of inking rollers; a plurality of ink applicator rollers for transferring ink between the plurality of inking rollers and the plate cylinder; providing a damping unit for supplying damping medium to the plate cylinder; configuring the damping unit to comprise: a damping medium reservoir for containing damping medium; a form roller, being disposed adjacent the plate cylinder, for transferring damning medium to the plate cylinder; means for transferring damping medium from the damping medium reservoir to the form roller; defining an interior of the printing press within the frame; providing dover means for selectively permitting access to the interior of the printing press from outside of the printing press; providing means for mounting the cover means on the printing press frame and for rendering the cover means displaceable with respect to the printing press frame; configuring the cover means to be positionable between a first position, a second position and third position, wherein: in the first position, the cover means is substantially fully closed and substantially impedes access to the interior of the printing press; in the second position, the cover means is substantially fully open and permits access to the interior of the printing press; and in the third position, the cover means is positioned intermediately between the first position and the second position and permits access to the interior of the printing press; the method further comprising the additional step of: selectively permitting access to the interior of the printing press from outside of the printing press by selectively positioning the cover means between the first position, the second position and the third position.

BRIEF DESCRIPTION OF THE DRAWINGS

The accompanying drawings are schematic illustrations of at least one embodiment of the present invention, wherein.

DESCRIPTION OF THE PREFERRED EMBODIMENTS

Figure 1:
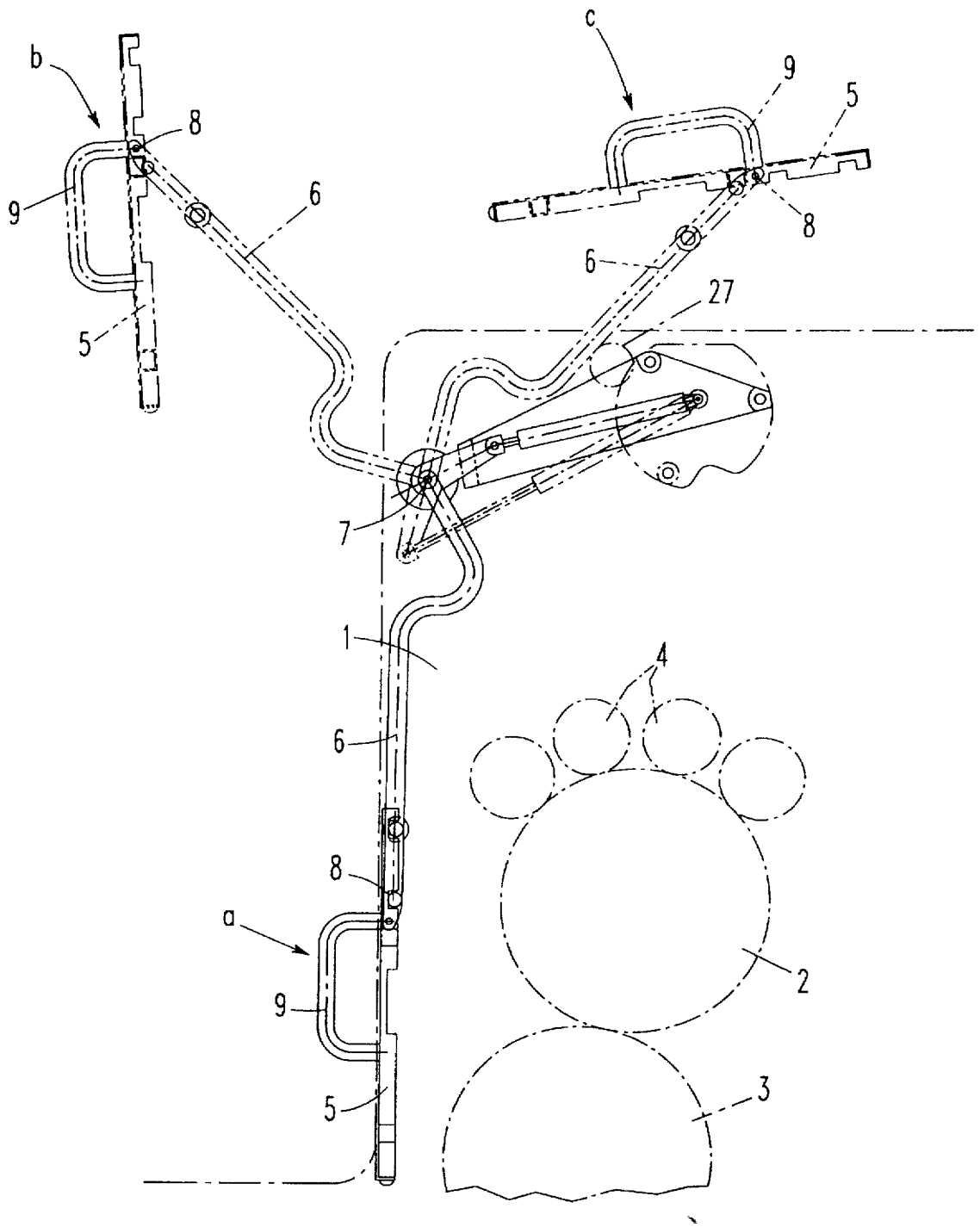
FIG. 1 shows a side view of the protection device in three positions.
Figure 1A:
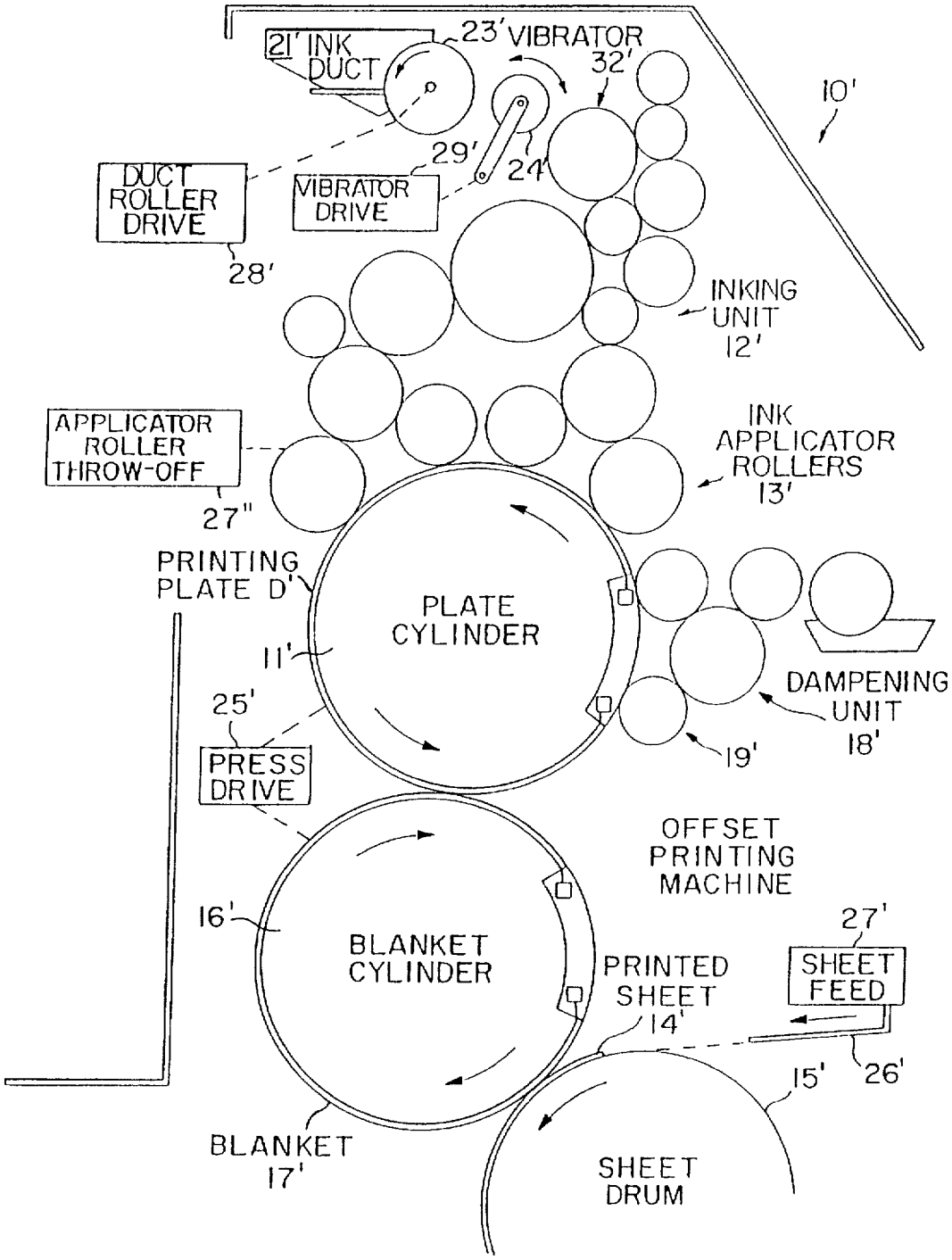
FIG. 1*a* illustrates a print stand of a printing press which can employ a protection device according to the present invention.

FIG. 1*a* illustrates a rotary print stand 10' of a rotary printing press which can employ a protection device according to the present invention. Rotary print stand 10' generally includes: a plate cylinder 11' for having mounted thereon a printing plate D'; an inking unit 12' which includes ink applicator rollers 13' for applying ink to the printing plate an ink profile; a dampening (or wetting) unit 18' having dampening applicator rollers 19' for transferring a dampening agent to the printing plate, a blanket cylinder 16' carrying a rubber blanket 17' for receiving an ink impression from the printing plate, and a sheet drum 15' for carrying a printed sheet 14' onto which the ink impression carried by blanket 17' is transferred. A duct roller 23' is typically mounted adjacent to an ink duet 21'. Typically, ink is transferred from duct roller 23' to inking unit 12' by means of a vibrator roller 24' which oscillates to successively pick up ink from duct roller 23' and deposit the same on a roller 32' of inking unit 10'. Typically, the printing stand 10' will also include auxiliary mechanisms such as, for example, a duct roller drive 28', a vibrator roller drive 29', an applicator roller throw-off 27" for lifting the ink applicator rollers 13' off of the printing plate, a press drive 25' and a sheet feed 27' for supplying the sheets to be printed 26' to sheet drum 15'.

It should be understood that the components discussed above with relation to Figure la may, if appropriate, essentially be considered to be interchangeable with similar components discussed herebelow with relation to FIGS. 1*b*–7.

Figure 1B:
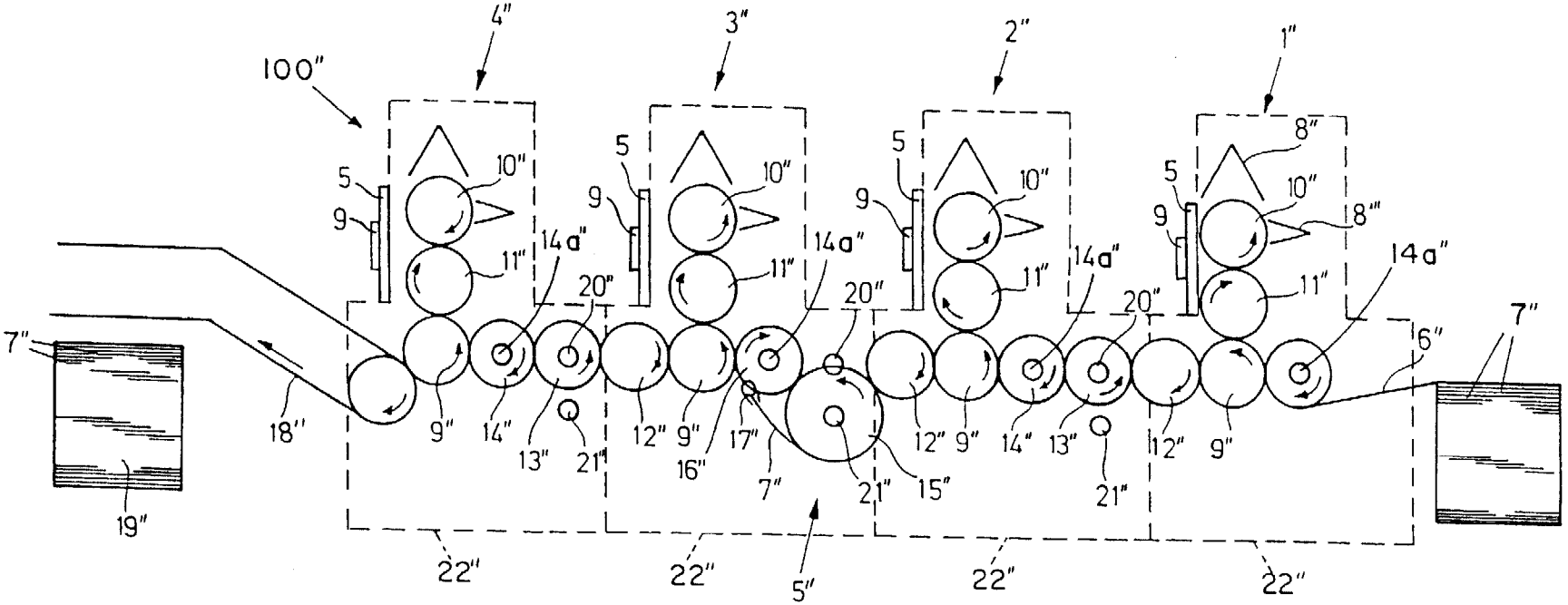
FIG. 1*b* illustrates a multi-unit printing press which can employ several protection devices according to the present invention.

FIG. 1*b* schematically illustrates a multi-unit printing press 100" which may employ several protective devices 5 according to the present invention. Particularly, a multi-unit printing press 100" may typically include a plurality of printing units, such as four printing units 1", 2", 3" end 4".

Each printing unit may typically include a support frame arrangement 22".

The sheets 7" to be processed can preferably be fed from a supply stock to the impression cylinder 9" of a first printing unit 1" by sheet feeder 6". Each sheet 7" can preferably receive its first ink application by means of plate cylinder 10" and blanket cylinder 11" of printing unit 1". Accordingly, each subsequent printing unit 2" 3" and 4" can also typically include its own plate cylinder 10" and blanket cylinder 11". Typically, an inking unit 8" and damping unit 8"' can be assigned to each plate cylinder 10".

In accordance with at least one preferred embodiment of the present invention, each printing unit 1", 2" 3" and 4" may have mounted, on the support frame arrangement 22" thereof, a protective device 5 with handles 9. Each protective device 5 can preferably operate, end be configured, in a manner such as that described herebelow with reference to FIGS. 1–7.

Other components illustrated in FIG. 1*b* but not otherwise described herein are discussed in U.S. Pat. No. 5,016,529 to Jahn, which is incorporated by reference herein. It should be understood that the protective device 5 can be suited for a wide variety of multi-unit printing presses in addition to that explicitly illustrated in FIG. 1*b* and described in U.S. Pat. No. 5,016,529.

It should be understood that the components discussed above with relation to FIG. 1*b* may, if appropriate, essentially be considered to be interchangeable with similar components discussed hereabove with relation to FIG. 1*a* and herebelow with relation to FIGS. 1–7.

FIG. 1 shows a printing mechanism, or print stand, or printing unit, I of a printing press or printing machine which has a plate cylinder 2, a blanket cylinder 3 and rollers 4 of an inking mechanism. To protect the operator, on the side of the printing mechanism, there is preferably a protective device 5 which is preferably mounted on both sides by means of swivel arms 6 on bearing Journals 7. The protective device 5 itself is preferably pivotably fastened, by means of pins 8, to the swivel arms 6, and preferably has handles 9 by means of which it can be pivoted.

By means of the handles 9, the protection device 5 can preferably be pivoted from the closed position a into a half-open intermediate position b, or into an open position c.

Figure 2:
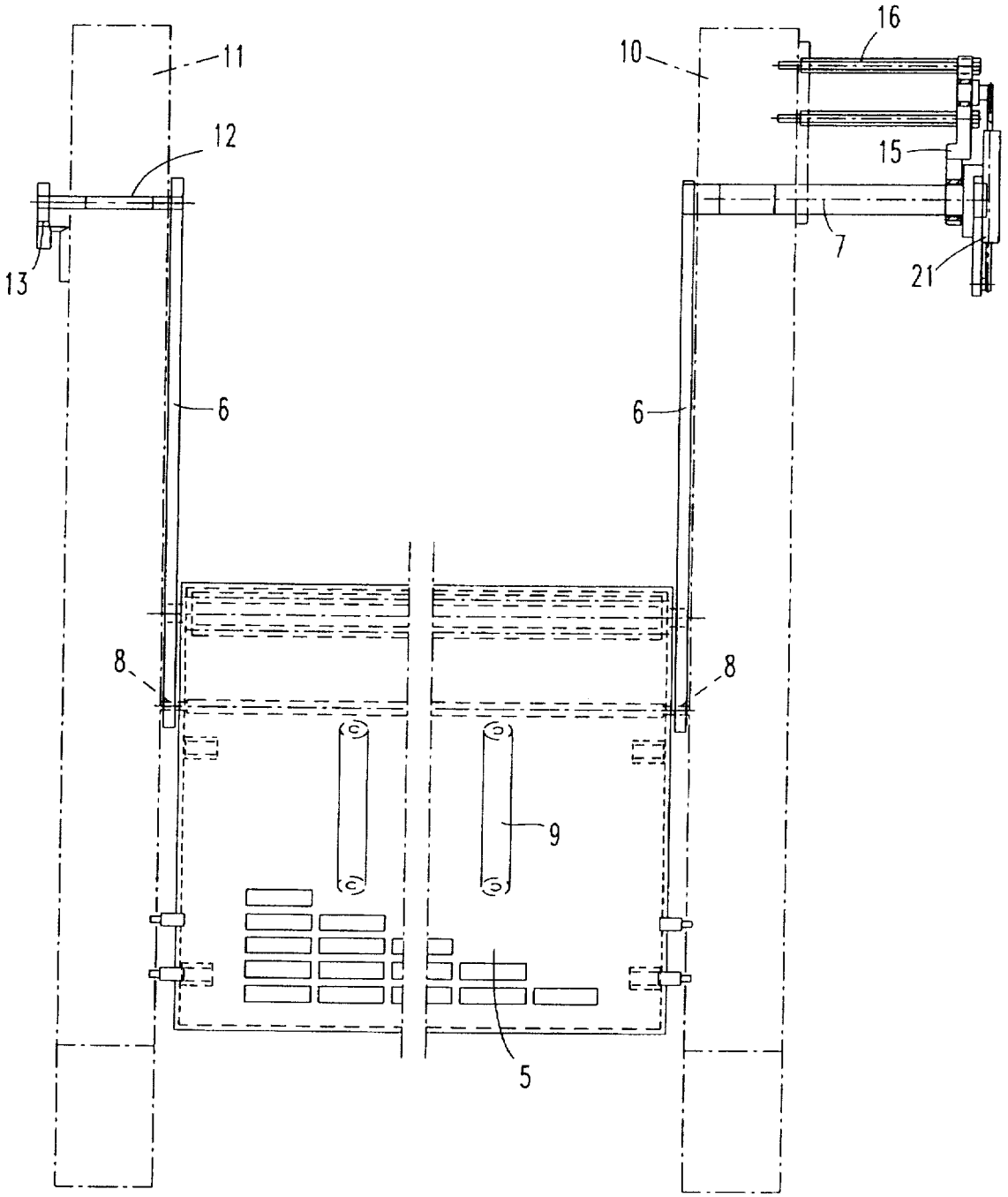
FIG. 2 shows a head-on view of the protection device.

As shown in FIG. 2, the shaft Journal 7 is preferably rotationally mounted in a side frame 10 of the printing machine. On the opposite side, a shaft journal 12 is also preferably mounted in a side frame 11, to which the opposite swivel arm 6 is preferably fastened. Outside the side frame 11, on the shaft journnal 12, there is preferably a safety switch 13 which prevents the printing machine from running or starting when the protection device 5 is raised.

Preferably, safety switch 13 will be activable so as to automatically shut off one or more components of the printing press or printing machine in response to the raising of the protective device 5. Since the makeup and functioning of switches of this genre are generally well-known, they will not be described in further detail herein.

Figure 3:
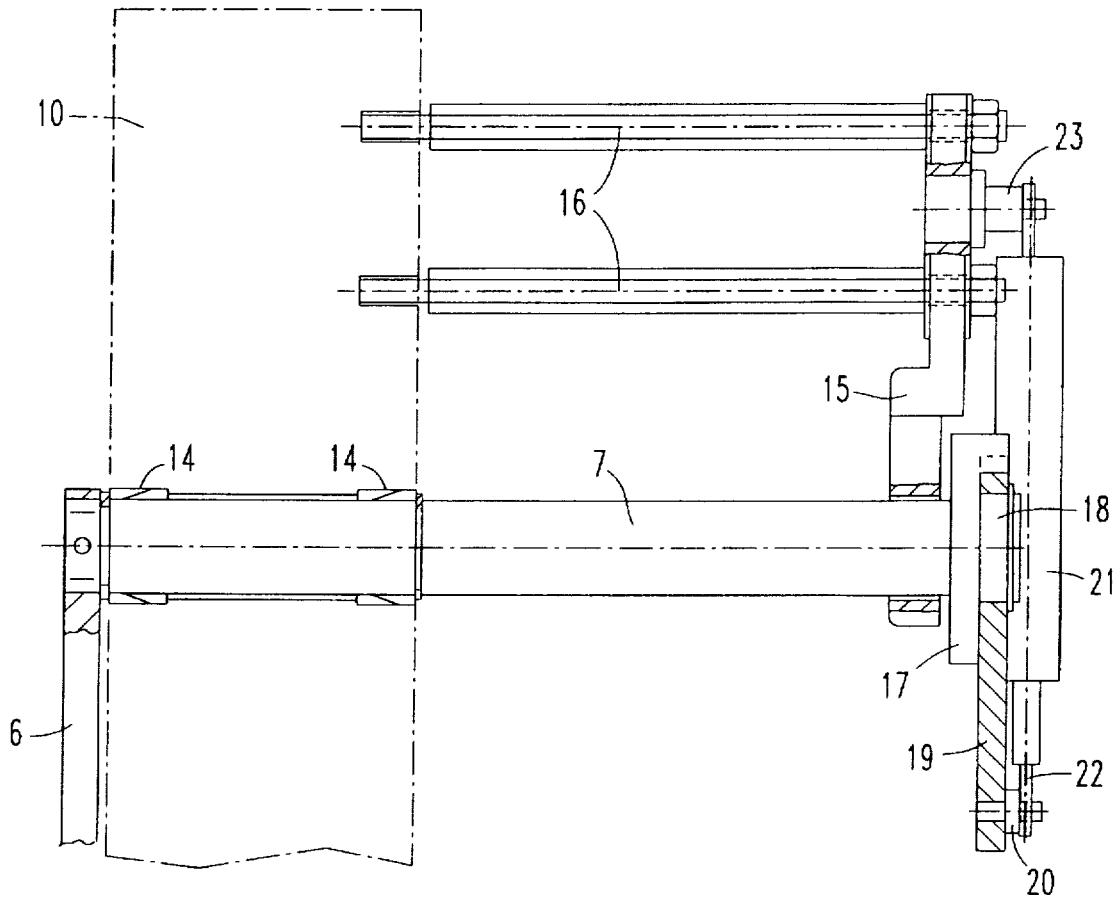
FIG. 3 shows an overhead view of the adjustment mechanism.
Figure 4:
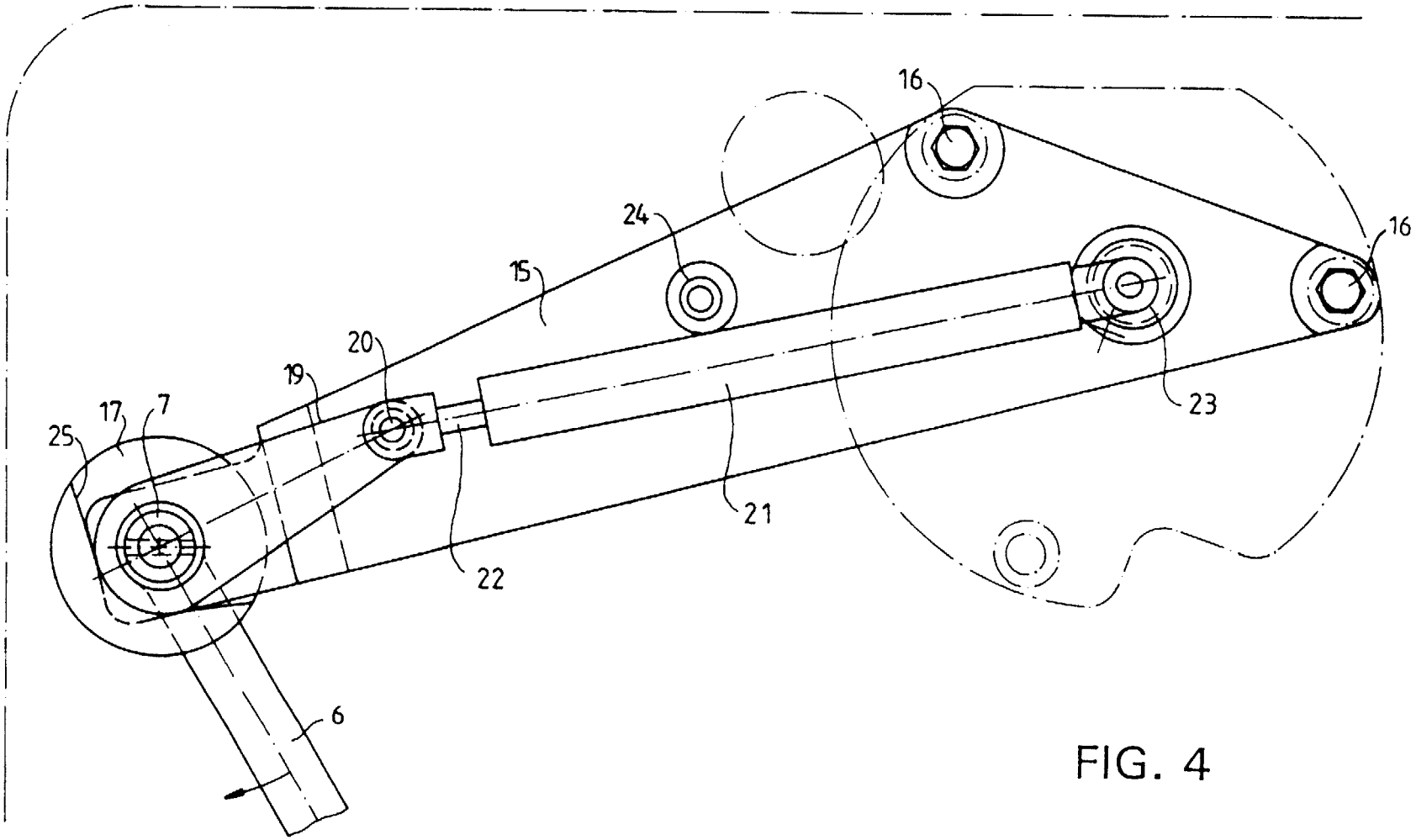
FIG. 4 shows a side view of the adjustment mechanism with a closed protection device.
Figure 5:
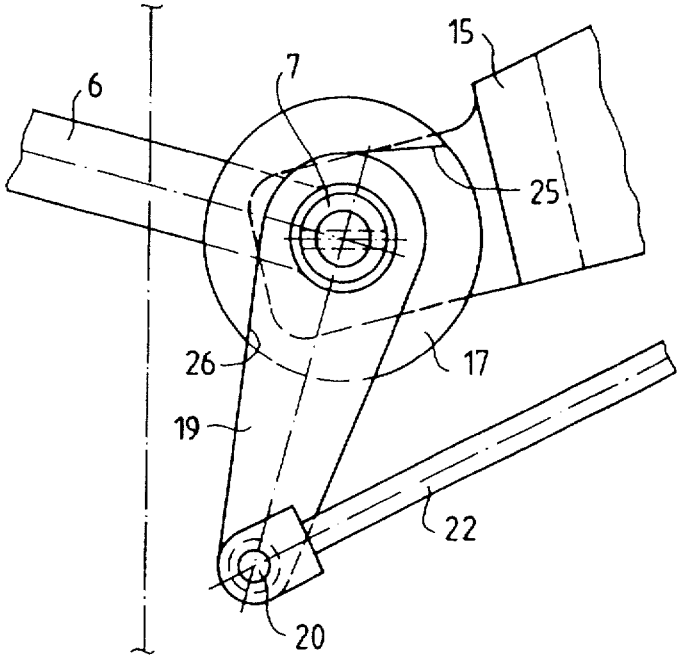
FIG. 5 shows the adjustment mechanism in the half-open position of the protection device.

FIG. 3 shows the shaft journal 7, on which a swivel arm 6 is preferably non-rotationally mounted inside the side frame 10. The shaft journal 7 is preferably rotationally mounted in the side frame 10 by means of bearing bushes 14. The shaft journal 7 is also preferably mounted in a bearing plate, or end plate, 15, which is preferably fastened to the side frame 10 by means of stay bolts 16. Outside the bearing plate 15, in the illustrated embodiment, the shaft journal 7 preferably supports e disc 17, which disc 17 is preferably non-rotationally connected to the shaft journal 7. Next to the disc 17, on the shaft journal 7, there is preferably a bearing journal 18, on which a lever 19 is preferably pivotably mounted. On the outer end of the lever 19 there is preferably a pin 20, on which a spring element 21 is preferably supported with its spring rod 22. On the opposite end, the spring element 21 is preferably mounted on a load-bearing bolt 23 which is fastened in the bearing plate In the side view shown in FIG. 4, the swivel arm 6 of the protection device 5 is shown in a position in which the protection device is closed, which position is designated a. In this case, the spring element 21 and the lever 19 can essentially be considered to be in a top-dead-center position, and are preferably supported on a stop 24 which is fastened to the bearing plate 15. When the protection device 5 is pivoted out of the closed position a, the disc 17 preferably rotates until a first stop 25 encounters the lever 19 and drives the lever 19 until it leaves the top-dead-center position, and the spring element 21 thence preferably continues to pivot the lever 19 until the spring element 21 assumes a stretched position (Figure 5). In this stretched position shown in FIG. 5, the protection device 5 is in the position b and the spring rod 22 is preferably fully extended. In this case, a second stop 26 which is fastened to the disc 17 is preferably placed in contact against the lever 19, and thus preferably supports the protection device 5 in this position.

Figure 6:
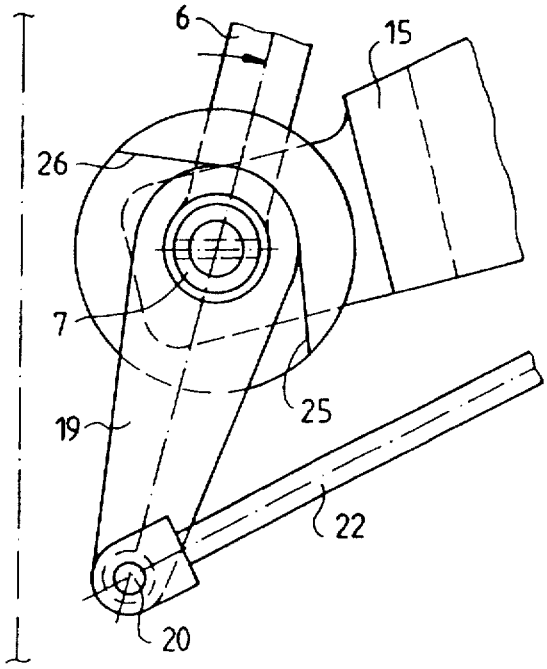
FIG. 6 shows the adjustment mechanism in the open position of the protection device.

If the operator of the printing machine wishes to raise the protection device 5 into the open position, or fully open position, designated c, the swivel arm 6 can preferably assume the position illustrated in FIG. 6. In this case, the disc 17 has been rotated until the first stop 25 and the second stop 26 essentially both no longer come into contact with the lever 19. In this position c, the swivel arms 6 are preferably placed in contact against a stop 27, which stop 27 is preferably integral with the frame (FIG. 1). In this position, the spring rod 22 and the lever 19 preferably do not change their position from the position illustrated in FIG. 5.

In accordance with at least one preferred embodiment of the present invention, the spring element 21 may preferably be embodied by a gas compression spring or pneumatic spring. Alternatively, the spring element 21 may conceivably include a coil spring or other type of biasing arrangement capable of biasing spring rod 22 towards its fully extended position.

Figure 7:
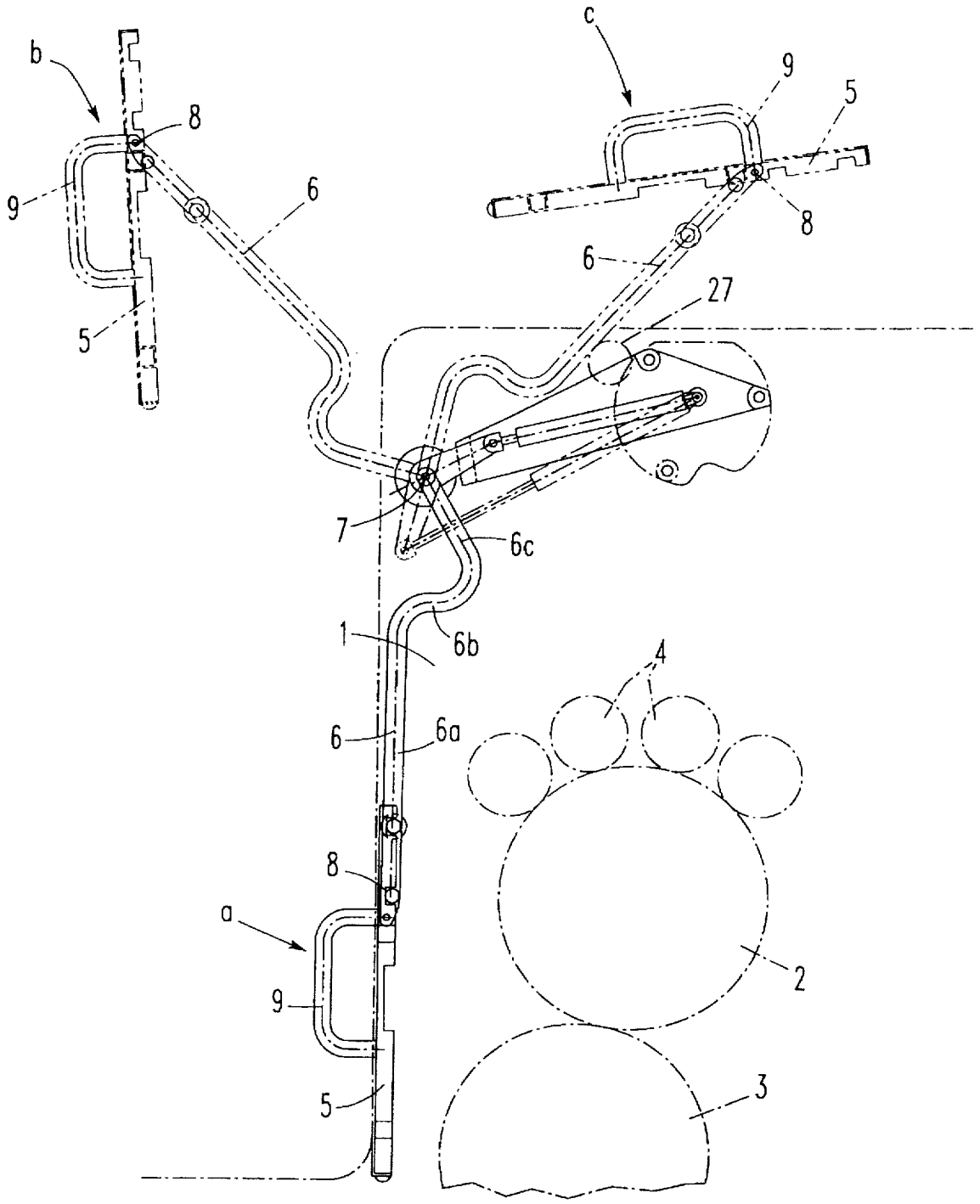
FIG. 7 is substantially the same view as FIG. 1, but more detailed.

Preferably, in accordance with at least one preferred embodiment of the present invention, as shown in FIG. 7, each swivel arm 6 can have a bent configuration whereby, in the closed position a:

there is preferably a lower, essentially straight portion 6*a*, which can preferably be essentially vertical;

there is preferably an intermediate portion 6*b* preferably extending from the top of the lower portion 6*a*, preferably extending generally horizontally and preferably being constituted essentially by two contiguous, adjoined arcs having a general "S" configuration and having a point of inflection; and there is preferably an upper portion 60, terminating at shaft journals 7 and 12, extending from the intermediate portion 6*b*, being essentially straight and being oriented at an angle of preferably about 60*a* with respect to the horizontal.

Preferably, when the protective cover 5 is in the closed position a, spring element 21 will be disposed against stop which stop 24 is preferably located directly above spring element 21. Thus, because spring element 21 is disposed against stop 24, spring rod 22 will essentially be prevented from extending further and causing lever 19 to move out of its original position.

Preferably, when the protective cover 5 is raised from position a to position b, the raising of cover 5, and subsequent pivoting of arms 6 and rotation of shaft journal 7, will preferably cause disc 17 to rotate. Through continued rotation of disc 17, stop 25 will preferably engage a surface of lever 19 and cause the same to undergo downward, clockwise rotational displacement with respect to the view shown in FIG. 1 and 4. Once lever 19 has been displaced past a position in which lever 19 and spring rod 22 are oriented at an angle of about 180° with respect to one another, spring rod 22, by virtue of the presence of an outwardly directed force component oriented parallel to spring rod 22, will preferably be able to itself continue to displace lever 19 in the aforementioned clockwise direction. This displacement of lever 19 will preferably continue until spring rod 22 has been fully extended by the outward biasing force provided by spring element 21. At this juncture, stop 26 of disc 17 will preferably be able to rest on an adjacent surface of lever 19, and the outward biasing force provided by spring element 21 will preferably be sufficient to hold lever 19 in position and simultaneously support protective cover 5 in position b through disc 17 and shaft journal 7.

In raising protective cover B from position b to position c, the lever 19, by way of the full extension of spring rod 22, will preferably remain in position. However, cover 5, with shaft journal 7 and disc 17, will preferably rotate with respect to lever 19 and will preferably continue to be displaced until swivel arms 6 come into contact with stop or stops 27. Conceivably, there may be one stop 27 to engage one swivel arm 6, or two stops 27 to engage both swivel arms 6. Conceivably, stop 27 may also be embodied by a cylindrical element extending Between side frames 10 and 11.

The return of protective cover 5 from position c to position b back to position a may preferably take place as essentially a reversal of the raising steps outlined immediately above. However, it will be appreciated that, in moving cover 5 from position b to position a, it can preferably be the case that lever 19 will be displaced in a counterclockwise direction (with respect to Figures I and 4) upon the application of a downward force on protective cover 5, such as via handles 9. Preferably, the downward force applied on protective cover 5 will be sufficient to transfer a rotational force to shaft journal 7 suitable for overcoming the biasing force provided by spring element 21. As such, lever 19 will preferably be displaced by stop 26 essentially against the biasing force provided through spring rod 22. Once lever 19 has been displaced past a position in which lever 19 and spring rod 22 are oriented at an angle of about 180° with respect to one another, spring rod 22, by virtue of the presence of an outwardly directed force component oriented parallel to spring rod 22, will preferably be able to itself continue to displace lever 19 in the aforementioned counterclockwise direction. Preferably, this will continue until spring element 21 comes into contact with stop 24, at which point spring rod 22 will preferably no longer be able to extend. At the same time, protective cover 5 and swivel arms 6 will be free to move into closed position e.

An additional advantage that will be appreciated with relation to at least one preferred embodiment of the present invent,ion is that, when a protective device 5 according to the present invention is in the intermediate position b, not only is it possible for an operator to access the cylinders of the printing unit or printing press in question, but it is also possible for the same operator or a different operator to access the printing unit or printing press from the top whereas, if the protective device is in the fully raised position c, the top of the printing unit or printing press may not be readily accessible. Such accessibility from the top may be desirable, for example, when it is desired that access be gained to the ink fountain or the upper portion of the inking unit.

One feature of the invention resides broadly in the protection device on printing machines which is mounted on both sides with swivel arms on shaft journals and can be raised from a closed position into an open position, whereby the pivoting is assisted by a spring element, characterized by the fact that the protection device 5 can be raised into a half-open intermediate position b, in which, by means of a stop 26 on a shaft journal 7, it is placed against a lever 19 supported by a spring element 21.

Another feature of the invention resides broadly in the protection device characterized by the fact that a shaft journal 7 which is permanently connected to a swivel arm 6 supports a disc 17 with stops 25, 26 on the end surfaces, that a lever 19 is mounted so that it can pivot on the shaft journal 7, and on the outer end of the lever 7, the spring element 21 is supported by means of a pin 20, that in the closed position a of the protection device 5, the spring element 21 and the lever 19 are in a top-dead-center position, and are in contact against a stop 24, that when the protection device 5 is pivoted out of the closed position a, the disc 17, by means of a first stop 25, pivots the lever 19 with the spring element 21 out of the top-dead-center position into a position in which the spring element 21 is stretched, and that in this position of the spring element 21, the protection device 5 in an intermediate position b is placed against the lever 19 by means of a second stop 26 on the disc 17.

Yet another feature of the invention resides broadly in the protection device characterized by the fact that the protection device 5 can Be raised from the intermediate position b into the open position c, and in this position is in contact against a stop 27 which is integral with the frame.

Still another feature of the invention resides broadly in the protection device characterized by the fact that the distance between the two stops 25, 26 on the disc 17 is less by several angular degrees than the pivoting range of the lever 19, so that the lever 19 with the spring element 21 is moved out of the top-dead-center position when the protection device 5 is pivoted into the intermediate position b.

A further feature of the invention resides broadly in the protection device characterized by the fact that the spring element 21 consists of a gas compression spring.

The appended drawings in their entirety, including all dimensions, proportions and/or shapes in at least one embodiment of the invention, are accurate and to scale and are hereby included by reference into this specification.

Examples of printing presses, and components therefor, which may be utilized in accordance with the embodiments of the present invention, may be found in the following U.S. Pat. Nos. 5,170,706, which issued to Rodi et al. on Dec. 15, 1992; U.S. Pat. No. 5,081,926, which issued to Rodi on Jan. 21, 1992; and U.S. Pat. No. 5,010,820, which issued to Löffler on Apr. 30, 1991. A printing press with protective covering is disclosed in U.S. Pat. No. 5,178,069, which issued to Rodi on Jan. 12, 1993.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 44 02 158.5, filed on Jan. 26, 1994, having inventor Michael Rehberg, and DE-OS P 44 02 158.5 and DE-PS P 44 02 158.5, as well as their published equivalents, and other equivalents or corresponding applications, if any, in corresponding eases in the Federal Republic of Germany and elsewhere, and the references cited in any of the documents cited herein, are hereby incorporated by reference as if set forth in their entirety herein.

The details in the patents, patent applications and publications may be considered to be interpotable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

NOMENCLATURE (FIGS. 1–7)

1 Printing mechanism
2 Plate cylinder
3 Blanket cylinder
4 Rollers
5 Protection device
6 Swivel arm
7 Shaft journal
8 Pin
9 Handle
10 Side frame
11 Side frame
13 Safety switch
14 Bearing bush
15 Bearing plate
16 Stay bolt
17 Disc
18 Bearing Journal
19 Lever
20 Pin
21 Spring element
22 Spring rod
23 Load-bearing bolt
24 Stop
25 Stop

What is claimed is:

1. A printing press comprising:

a frame;

a plate cylinder being rotatably mounted on said frame;

an inking unit for supplying ink to said plate cylinder;

said inking unit comprising:

an ink fountain for containing ink;

a plurality of inking rollers;

means for transferring ink between said ink fountain and said plurality of inking rollers; and a plurality of ink applicator rollers for transferring ink between said plurality of inking rollers and said plate cylinder;

a damping unit for supplying damping medium to said plate cylinder;

said printing press having an interior defined within said frame;

cover means for selectively permitting access to said interior of said printing press from outside of said printing press;

means for mounting said cover means on said printing press frame and for rendering said cover means displaceable with respect to said printing press frame;

said cover means being positionable between a first position, a second position and third position, wherein:

in said first position, said cover means is substantially fully closed and substantially impedes access to said interior of said printing press;

in said second position, said cover means is substantially fully open and permits access to said interior of said printing press; and in said third position, said cover means is positioned intermediately between said first position and said second position and permits access to said interior of said printing press;

means for holding said cover means in said third, intermediate positions;

said mounting means comprising means, for being supported by said holding means, to hold said cover means in said third, intermediate position;

said mounting means comprising at least one shaft member being rotatably mounted with respect to said frame;

said means for being supported by said holding means comprising a support portion being fixedly connected with respect to said at least one shaft member;

said holding means comprising means for biasing against said support portion so as to hold said support portion at a predetermined position, and hold said cover means in said third, intermediate position;

said frame comprising a pair of sides, said plate cylinder and said plurality of inking rollers being mounted between said sides;

said cover means comprising a protective cover;

said mounting means comprising means for mounting said protective cover between both sides of said frame;

said at least one shaft member comprising a pair of shaft journals, each one of said pair of shaft journals being rotatably mounted at a corresponding side of said printing press; and said mounting means comprising:

a pair of swivel arms, each of said pair of swivel arms being fixedly mounted with respect to a corresponding one of said shaft journals; and pivot means for pivotably mounting said protective cover on said swivel arms.

2. The printing press according to claim 1, wherein:

said support portion comprises a disc being fixedly connected to one of said shaft journals;

said means for biasing against said support portion comprises:

a bearing journal being non-rotationally connected to said one of said shaft journals;

a lever being pivotably mounted at said bearing journal;

said lever having a first end and a second end, said lever being pivotably mounted on said bearing journal at said first end of said lever;

a pin being fixedly connected to said second end of said lever; and a spring element being mounted between said pin and one of said sides of said frame of said printing press.

3. The printing press according to claim 2, further comprising:

said spring element comprising a hydraulic spring, said hydraulic spring comprising a cylinder and a piston rod being axially displaceable with respect to said cylinder;

said piston rod having an outer end disposed away from said cylinder, said outer end being pivotably mounted at said pin of said lever;

a stop portion being fixedly mounted with respect to said frame of said printing press, said cylinder being disposed against said stop portion with said cover means being in said first, closed position;

said hydraulic spring being configured to provide an axially outwardly directed biasing force through said outer end of said piston rod; and said hydraulic spring being configured to urge displacement of said lever in a first rotational direction with said cover means being in said first, closed position, this urged displacement being inhibited by said stop portion.

4. The printing press according to claim 3, wherein:

said disc comprises a first stop;

said first stop being configured to engage with a portion of said lever upon displacement of said cover means away from said first position;

said lever being configured to displace in a second rotational direction upon engagement of said first stop with said portion of said lever;

said lever being configured to urge displacement of said cylinder of said hydraulic spring away from said stop portion upon said lever being displaced in said second rotational direction in response to engagement of said first stop with said portion of said lever;

said hydraulic spring being configured to further displace said lever in said second rotational direction upon sufficient initial displacement of said lever, in response to the engagement of said first stop with said portion of said lever, in said second rotational direction;

said hydraulic spring being configured to urge continued displacement of said lever in said second rotational direction up to full extension of said piston rod away from said cylinder;

said hydraulic spring being configured such that said piston rod continues to hold said lever in a substantially stationary position with said piston rod being fully extended away from said cylinder; and said disc comprising a second stop, said second stop being configured to engage with, be supported by, and rest upon, another portion of said lever with said cover means being in said third, intermediate position.

5. The printing press according to claim 4, further comprising:

an additional stop portion being fixedly mounted with respect to said frame of said printing press; and said additional stop portion being configured to support at least one of said swivel arms with said cover means being in said second, fully open position.

6. The printing press according to claim 5, wherein:

said first and second stops of said disc define an angular distance therebetween;

said lever has a range of pivoting defined as an angular distance, between said portion of said lever and said another portion of said lever; and said angular distance defined between said first and second stops is less, by a substantial number of angular degrees, than said angular distance defined by the pivoting range of said lever.

7. The printing press according to claim 6, wherein:

said spring element consists of a gas compression spring;

said protective cover having a first edge portion and a second edge portion disposed opposite said first portion, said first edge portion being pivotably mounted at a first of said swivel arms, and said second edge portion of said protective cover being pivotably mounted at a second of said swivel arms;

said protective cover comprises handle means for receiving a force to permit manual displacement of said protective cover;

safety switch means, responsive to displacement of at least said shaft means, being configured to alter operation of said printing press upon said protective cover being displaced away from said first, closed position;

said cover means being displaceable from said third position to said first position upon application of a downward force on said cover means sufficient to transfer a rotational force to said shaft journal suitable for overcoming the biasing force provided by said hydraulic spring;

said lever being configured to be displaced by said second stop against the biasing force provided by said hydraulic spring; and said hydraulic spring being configured to urge displacement of said lever in said first rotational direction until said cylinder contacts said stop portion.

8. In a printing press, such a printing press comprising: a frame; a plate cylinder being rotatably mounted on said frame; an inking unit for supplying ink to said plate cylinder; said inking unit comprising: an ink fountain for containing ink; a plurality of inking rollers; means for transferring ink between said ink fountain and said plurality of inking rollers; a plurality of ink applicator rollers for transferring ink between said plurality of inking rollers and said plate cylinder; a damping unit for supplying damping medium to said plate cylinder; said printing press having an interior defined within said frame;

a cover arrangement comprising:

cover means for selectively permitting access to said interior of said printing press from outside of said printing press;

means for mounting said cover means on said printing press frame and for rendering said cover means displaceable with respect to said printing press frame;

said cover means being positionable between a first position, a second position and third position, wherein:

in said first position, said cover means is substantially fully closed and substantially impedes access to the interior of a printing press;

in said second position, said cover means is substantially fully open and permits access to the interior of a printing press; and in said third position, said cover means is positioned intermediately between said first position and said second position and permits access to said interior of said printing press;

means for holding said cover means in said third, intermediate position;

said mounting means comprising means, for being supported by said holding means, to hold said cover means in said third, intermediate position;

said mounting means comprising at least one shaft member being rotatably mounted with respect to said frame;

said means for being supported by said holding means comprising a support portion being fixedly connected with respect to said at least one shaft member;

said holding means comprises means for biasing against said support portion so as to hold said support portion at a predetermined position, and hold said cover means in said third, intermediate position;

said frame comprising a pair of sides, said plate cylinder and said plurality of inking rollers being mounted between said sides;

said cover means comprising a protective cover;

said mounting means comprising means for mounting said protective cover between both sides of said frame;

said at least one shaft member comprising a pair of shaft journals, each one of said pair of shaft journals being rotatably mounted at a corresponding side of said printing press; and said mounting means comprising:

a pair of swivel arms, each of said pair of swivel arms being fixedly mounted with respect to a corresponding one of said shaft journals; and pivot means for pivotably mounting said protective cover on said swivel arms.

9. In a printing press according to claim 8, wherein:

said support portion comprises a disc being fixedly connected to one of said shaft journals;

said means for biasing against said support portion comprises:

a bearing journal being non-rotationally connected to said one of said shaft journals;

a lever being pivotably mounted at said bearing journal;

said lever having a first end and a second end, said lever being pivotably mounted on said bearing journal at said first end of said lever;

a pin being fixedly connected to said second end of said lever; and a spring element being mounted between said pin and one of said sides of said frame of said printing press.

10. In a printing press according to claim 9, wherein:

said spring element comprises a hydraulic spring, said hydraulic spring comprising a cylinder and a piston rod being axially displaceable with respect to said cylinder;

said piston rod has an outer end disposed away from said cylinder, said outer end being pivotably mounted at said pin of said lever;

said cover arrangement comprises a stop portion being fixedly mounted with respect to said frame of said printing press, said cylinder being disposed against said stop portion with said cover means being in said first, closed position;

said hydraulic spring being configured to provide an axially outwardly directed biasing force through said outer end of said piston rod; and said hydraulic spring being configured to urge displacement of said lever in a first rotational direction with said cover means being in said first, closed position, this urged displacement being inhibited by said stop portion.

11. In a printing press according to claim 10, wherein:

said disc comprises a first stop;

said first stop being configured to engage with a portion of said lever upon displacement of said cover means away from said first position;

said lever being configured to displace in a second rotational direction upon engagement of said first stop with said portion of said lever;

said lever being configured to urge displacement of said cylinder of said hydraulic spring away from said stop portion upon said lever being displaced in said second rotational direction in response to engagement of said first stop with said portion of said lever;

said hydraulic spring being configured to further displace said lever in said second rotational direction upon sufficient initial displacement of said lever, in response to the engagement of said first stop with said portion of said lever, in said second rotational direction;

said hydraulic spring being configured to urge continued displacement of said lever in said second rotational direction up to full extension of said piston rod away from said cylinder;

said hydraulic spring being configured such that said piston rod continues to hold said lever in a substantially stationary position with said piston rod being fully extended away from said cylinder; and said disc comprising a second stop, said second stop being configured to engage with, be supported by, and rest upon, another portion of said lever with said cover means being in said third, intermediate position.

12. In a printing press according to claim 11, wherein:

said cover arrangement further comprises an additional stop portion being fixedly mounted with respect to said frame of said printing press; and said additional stop portion is configured to support at least one of said swivel arms with said cover means being in said second, fully open position.

13. In a printing press according to claim 12, wherein:

said first and second stops of said disc define an angular distance therebetween;

said lever has a range of pivoting defined as an angular distance between said portion of said lever and said another portion of said lever; and said angular distance defined between said first and second stops is less, by a substantial number of angular degrees, than said angular distance defined by the pivoting range of said lever.

14. In a printing press according to claim 13, wherein:

said spring element consists of a gas compression spring;

said protective cover having a first edge portion and a second edge portion disposed opposite said first said portion, said first edge portion being pivotably mounted at a first of said swivel arms, and said second edge portion of said protective cover being pivotably mounted at a second of said swivel arms;

said protective cover comprises handle means for receiving a force to permit manual displacement of said protective cover;

safety switch means, responsive to displacement of at least said shaft means, being configured to alter operation of said printing press upon said protective cover being displaced away from said first, closed position;

said cover means being displaceable from said third position to said first position upon application of a downward force on said cover means sufficient to transfer a rotational force to said shaft journal suitable for overcoming the biasing force provided by said hydraulic spring;

said lever being configured to be displaced by said second stop against the biasing force provided by said hydraulic spring; and said hydraulic spring being configured to urge displacement of said lever in said first rotational direction until said cylinder contacts said stop portion.

15. A method of operating a printing press, such a printing press comprising: a frame; a plate cylinder being rotatably mounted on the frame; an inking unit for supplying ink to the plate cylinder; the inking unit comprising: an ink fountain for containing ink, a plurality of inking rollers, means for transferring ink between the ink fountain and the plurality of inking rollers, and a plurality of ink applicator rollers for transferring ink between the plurality of inking rollers and the plate cylinder; a damping unit for supplying damping medium to the plate cylinder; the damping unit comprising: a damping medium reservoir for containing damping medium, a form roller being disposed adjacent the plate cylinder, the form roller for transferring damping medium to the plate cylinder, means for transferring damping medium from the damping medium reservoir to the form roller; the printing press having an interior defined within the frame; cover means for selectively permitting access to the interior of the printing press from outside of the printing press; means for mounting the cover means on the printing press frame and for rendering the cover means displaceable with respect to the printing press frame; the cover means being positionable between a first position, a second position and third position, wherein: in the first position, the cover means is substantially fully closed and substantially impedes access to the interior of the printing press; in the second position, the cover means is substantially fully open and permits access to the interior of the printing press; and in the third position, the cover means is positioned intermediately between the first position and the second position and permits access to the interior of the printing press; said method comprising the steps of:

providing a frame;

providing a plate cylinder and rotatably mounting the plate cylinder on the frame;

providing an inking unit for supplying ink to the plate cylinder;

configuring the inking unit to comprise:

an ink fountain for containing ink;

a plurality of inking rollers;

means for transferring ink between the ink fountain and the plurality of inking rollers;

a plurality of ink applicator rollers for transferring ink between the plurality of inking rollers and the plate cylinder;

providing a damping unit for supplying damping medium to the plate cylinder;

configuring the damping unit to comprise:

a damping medium reservoir for containing damping medium;

a form roller, being disposed adjacent the plate cylinder, for transferring damping medium to the plate cylinder;

means for transferring damping medium from the damping medium reservoir to the form roller;

defining an interior of the printing press within the frame;

providing cover means for selectively permitting access to the interior of the printing press from outside of the printing press;

providing means for mounting the cover means on the printing press frame and for rendering the cover means displaceable with respect to the printing press frame;

configuring the cover means to be positionable between a first position, a second position and third position, wherein:

in the first position, the cover means is substantially fully closed and substantially impedes access to the interior of the printing press;

in the second position, the cover means is substantially fully open and permits access to the interior of the printing press; and in the third position, the cover means is positioned intermediately between the first position and the second position and permits access to the interior of the printing press;

selectively permitting access to the interior of the printing press from outside of the printing press by selectively positioning the cover means between the first position, the second position and the third position;

providing means for holding the cover means in the third, intermediate position;

said step of providing mounting means comprising the step of providing means, for being supported by the holding means, to hold the cover means in the third, intermediate position; holding the cover means in the third, intermediate position by supporting, with the holding means, the means for being supported by the holding means;

configuring the mounting means to comprises at least one shaft member being rotatably mounted with respect to the frame;

configuring the means for being supported by the holding means to comprise a support portion being fixedly connected with respect to the at least one shaft member;

configuring the holding means to comprise means for biasing against the support portion so as to hold the support portion at a predetermined position, and hold the cover means in the third, intermediate position;

configuring the frame to comprises a pair of sides, the plate cylinder and the plurality of inking rollers being mounted between the sides;

configuring the cover means to comprise a protective cover;

configuring the mounting means to comprise means for mounting the protective cover between both sides of the frame;

configuring the at least one shaft member to comprise a pair of shaft journals, each one of the pair of shaft journals being rotatably mounted at a corresponding side of the printing press; and configuring the mounting means to comprise:

a pair of swivel arms, each of the pair of swivel arms being fixedly mounted with respect to a corresponding one of the shaft journals; and pivot means for pivotably mounting the protective cover on the swivel arms.

16. The method according to claim 15, comprising the steps of:

configuring the support portion to comprise a disc being fixedly connected to one of the shaft journals;

configuring the means for biasing against the support portion to comprise:

a bearing journal being non-rotationally connected to the one of the shaft journals;

a lever being pivotably mounted at the bearing journal;

the lever having a first end and a second end, the lever being pivotably mounted on the bearing journal at the first end of the lever;

a pin being fixedly connected to the second end of the lever; and a spring element being mounted between the pin and one of the sides of the frame of the printing press.

17. The method according to claim 16, comprising the steps of:

configuring the spring element to comprise a hydraulic spring, the hydraulic spring comprising a cylinder and a piston rod being axially displaceable with respect to the cylinder;

configuring the piston rod to have an outer end disposed away from the cylinder, the outer end being pivotably mounted at the pin of the lever;

providing a stop portion being fixedly mounted with respect to the frame of the printing press, the cylinder being disposed against the stop portion with the cover means being in the first, closed position;

configuring the hydraulic spring to:

provide an axially outwardly directed biasing force through the outer end of the piston rod; and urge displacement of the lever in a first rotational direction with the cover means being in the first, closed position, this urged displacement being inhibited by the stop portion.

18. The method according to claim 17, comprising the steps of:

configuring the disc to comprise a first stop;

configuring the first stop to engage with a portion of the lever upon displacement of the cover means away from the first position;

configuring the lever to displace in a second rotational direction upon engagement of the first stop with the portion of the lever;

configuring the lever to urge displacement of the cylinder of the hydraulic spring away from the stop portion upon the lever being displaced in the second rotational direction in response to engagement of the first stop with the portion of the lever;

configuring the hydraulic spring to further displace the lever in the second rotational direction upon sufficient initial displacement of the lever, in response to the engagement of the first stop with the portion of the lever, in the second rotational direction;

configuring the hydraulic spring to urge continued displacement of said lever in said second rotational direction up to full extension of the piston rod away from the cylinder;

configuring the hydraulic spring such that the piston rod continues to hold said lever in a substantially stationary position with the piston rod being fully extended away from the cylinder; and configuring the disc to comprise a second stop, the second stop being configured to engage with, be supported by, and rest upon, another portion of said lever with the cover means being in the third, intermediate position;

said method comprising the additional steps of:

positioning the cover means between the first and third positions by way of the following steps:

initially holding the cover means in the first, fully closed position by urging displacement of the lever in the first rotational direction, and against the stop portion, by the the hydraulic spring, with the cover means being in the first, closed position;

thereafter displacing the cover means away from the first position and subsequently engaging the first stop with a portion of the lever and displace the lever in the second rotational direction;

thereafter urging displacement of the cylinder of the hydraulic spring away from the stop portion upon the lever being displaced in the second rotational direction in response to engagement of the first stop with the portion of the lever;

thereafter further displacing the lever in the second rotational direction upon sufficient initial displacement of the lever, in response to the engagement of the first stop with the portion of the lever, in the second rotational direction;

thereafter urging continued displacement of the lever in the second rotational direction up to full extension of the piston rod away from the cylinder;

thereafter continuing to hold the lever in a substantially stationary position with the piston rod being fully extended away from the cylinder; and thereafter performing the step of holding the cover means in the third, intermediate position by engaging the second stop with, supporting the same by, and resting the same upon, another portion of the lever.

19. The method according to claim 18, further comprising the steps of:

providing an additional stop portion being fixedly mounted with respect to the frame of the printing unit;

configuring the additional stop portion to support at least one of the swivel arms with the cover means being in the second, fully open position; and said method further comprising the additional step of positioning the cover means between the third and second positions by:

displacing the cover means from the third, intermediate position to the second, fully open position; and thereafter supporting at least one of the swivel arms by the additional stop portion, with the cover means being in the second, fully open position.

* * * * *

UNITED STATES PATENT AND TRADEMARK OFFICE

CERTIFICATE OF CORRECTION

PATENT NO. : 5,613,438

DATED : March 25, 1997

INVENTOR(S) : Michael REHBERG

It is certified that error appears in the above-indentified patent and that said Letters Patent is hereby corrected as shown below:

In column 2, line 21, after 'the', delete "free." and insert --frame.--.

In column 2, line 47, before 'mounted', delete "rot drably" and insert --rotatably--.

In column 3, line 19, after 'having', delete "en" and insert --an--.

In column 3, line 32, after the first occurrence of 'position', delete "end" and insert --and--.

In column 3, line 34, after 'steps', delete "oft" and insert --of:--.

In column 3, lines 46-47, after 'transferring', delete "damning" and insert --damping--.

In column 6, line 58, after 'portion', delete "60," and insert --6c,--.

In column 6, line 61, after 'about', delete "60a" and insert --60°--.

UNITED STATES PATENT AND TRADEMARK OFFICE

CERTIFICATE OF CORRECTION

PATENT NO. : 5,613,438

DATED : March 25, 1997

INVENTOR(S) : Michael REHBERG

It is certified that error appears in the above-indentified patent and that said Letters Patent is hereby corrected as shown below:

In column 7, line 25, after 'cover', delete "B" and insert --5--.

In column 7, line 60, after 'position', delete "e." and insert --a.--.

In column 10, lines 19-20, Claim 1, after 'intermediate', delete "positions;" and insert --position;--.

Signed and Sealed this

First Day of July, 1997

Bruce Lehman

*Attest:*

BRUCE LEHMAN

*Attesting Officer*

*Commissioner of Patents and Trademarks*